US009035206B2

(12) United States Patent
Kalous et al.

(10) Patent No.: US 9,035,206 B2
(45) Date of Patent: May 19, 2015

(54) ELECTRIC SWITCH

(71) Applicants: Lukas Kalous, Vermerovice (CS); Pavel Mrtvy, Prerov (CS); Milos Petracek, Letohrad (CS); Daniel Vavra, Vyprachtice (CS)

(72) Inventors: Lukas Kalous, Vermerovice (CS); Pavel Mrtvy, Prerov (CS); Milos Petracek, Letohrad (CS); Daniel Vavra, Vyprachtice (CS)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 86 days.

(21) Appl. No.: 13/670,816

(22) Filed: Nov. 7, 2012

(65) Prior Publication Data

US 2013/0118870 A1 May 16, 2013

(30) Foreign Application Priority Data

Nov. 14, 2011 (DE) ..... 10 2011 086 307

(51) Int. Cl.

*H01H 9/00* (2006.01)
*H01H 71/04* (2006.01)
*H01H 9/16* (2006.01)
(Continued)

(52) U.S. Cl.

CPC ..... *H01H 71/04* (2013.01); *H01H 9/16* (2013.01); *H01H 71/24* (2013.01); *H01H 1/2058* (2013.01)

(58) Field of Classification Search

CPC ..... H01H 9/28; H01H 9/0027; H01H 9/02; H01H 73/00; H01H 73/06; H01H 75/00; H01H 77/00; H01H 85/045; H01H 85/05; H01H 2019/00

USPC ..... 200/308, 1 R, 5 R, 16 R, 410, 502, 19.2, 200/19.22, 19.27, 19.3, 293, 294, 295, 200/302.3, 19.18, 51 R, 179, 50.1–50.4, 200/17 R

See application file for complete search history.

(56) References Cited

U.S. PATENT DOCUMENTS 5,477,016 A 12/1995 Baginski et al.
6,107,902 A * 8/2000 Zhang et al. ..... 335/17
6,495,781 B2 * 12/2002 Greenberg et al. ..... 200/308
(Continued)

FOREIGN PATENT DOCUMENTS

DE 69021931 T2 4/1996
DE 69405022 T2 1/1998
(Continued)

OTHER PUBLICATIONS

German Office Action for Priority Application No. DE 10 2011 086 307.9 dated Aug. 7, 2012.
(Continued)

*Primary Examiner* — Edwin A. Leon
*Assistant Examiner* — Anthony R. Jimenez
(74) *Attorney, Agent, or Firm* — Harness, Dickey & Pierce, P.L.C.

(57) ABSTRACT

An embodiment relates to an electric switch, particularly an electric circuit-breaker, including a rotor housing that can be turned to an ON and an OFF position and at least one electric contact arm that is mounted rotatably in the rotor housing and can be swiveled jointly with as well as relatively to it. A display element is included that is coupled indirectly or directly to the rotor housing and which in one display position indicates the ON position of the rotor housing and in another display position indicates the OFF position of the rotor housing.

19 Claims, 5 Drawing Sheets

(51) Int. Cl.
*H01H 71/24* (2006.01)
*H01H 1/20* (2006.01)

(56) References Cited

U.S. PATENT DOCUMENTS

| | | | |
|---|---|---|---|
| 6,960,731 | B2 | 11/2005 | Azzola et al. |
| 2002/0079207 | A1 | 6/2002 | Greenberg et al. |

FOREIGN PATENT DOCUMENTS

| | | | |
|---|---|---|---|
| DE | 69405022 | T2 | 1/1998 |
| DE | 10222360 | A1 | 12/2003 |
| DE | 60212701 | T2 | 6/2007 |
| DE | 60212701 | T2 | 6/2007 |
| DE | 102008039066 | A1 | 2/2010 |
| JP | S4423644 | Y | 10/1969 |

OTHER PUBLICATIONS

German Priority Document Application No. DE 10 2011 086 307.9 filed Nov. 14, 2011.

Search Report for corresponding European patent application No. 12185026.7 dated Aug. 8, 2014.

* cited by examiner

ELECTRIC SWITCH

PRIORITY STATEMENT

The present application hereby claims priority under 35 U.S.C. §119 to German patent application number DE 10 2011 086 307.9 filed Nov. 14, 2011, the entire contents of which are hereby incorporated herein by reference.

FIELD

At least one embodiment of the invention generally relates to an electric switch, particularly an electric circuit-breaker, having a rotor housing that can be turned to an ON and an OFF position and at least one electric contact arm that is mounted rotatably in the rotor housing and can be swiveled jointly with as well as relatively to it.

BACKGROUND

A switch of such kind is known from published German patent application DE 10 2008 039 066 A1. The switch includes a rotor housing and a contact bridge having two electric contact arms that is mounted rotatably in the rotor housing and can be swiveled between an ON and an OFF position as well as relatively to the rotor housing. In the ON position the electric contact bridge connects contact elements of the contact bridge to stationary contact elements of the switch. In the OFF position the contact elements of the contact bridge and the stationary contact elements of the switch are separated. For switching on and off, the contact bridge can be swiveled by turning the rotor housing, with the turning rotor housing therein co-swiveling the contact bridge. The contact bridge can moreover also swivel or, as the case may be, turn without the rotor housing's being turned, meaning relatively to the rotor housing, and assume a "triggered" position specifically if the current flowing across the contact bridge becomes excessively large: In that case the contact bridge will be swiveled relative to the rotor housing by a magnetic force induced by the current, as a result of which the contact elements of the contact bridge and the stationary contact elements of the switch will be mutually separated.

SUMMARY

A switch is disclosed that enables particularly safe handling by operating personnel.

Advantageous embodiments of the inventive switch are described in subclaims.

A switch of at least one embodiment includes a display element that is coupled indirectly or directly to the rotor housing and, in one display position, indicates the rotor housing's ON position and, in another display position, indicates the rotor housing's OFF position.

BRIEF DESCRIPTION OF THE DRAWINGS

The invention is explained in more detail below with the aid of example embodiments.

For the sake of clarity, in all cases the same reference numerals are used in the figures for components that are identical or comparable.

DETAILED DESCRIPTION OF THE EXAMPLE EMBODIMENTS

Figure 1:
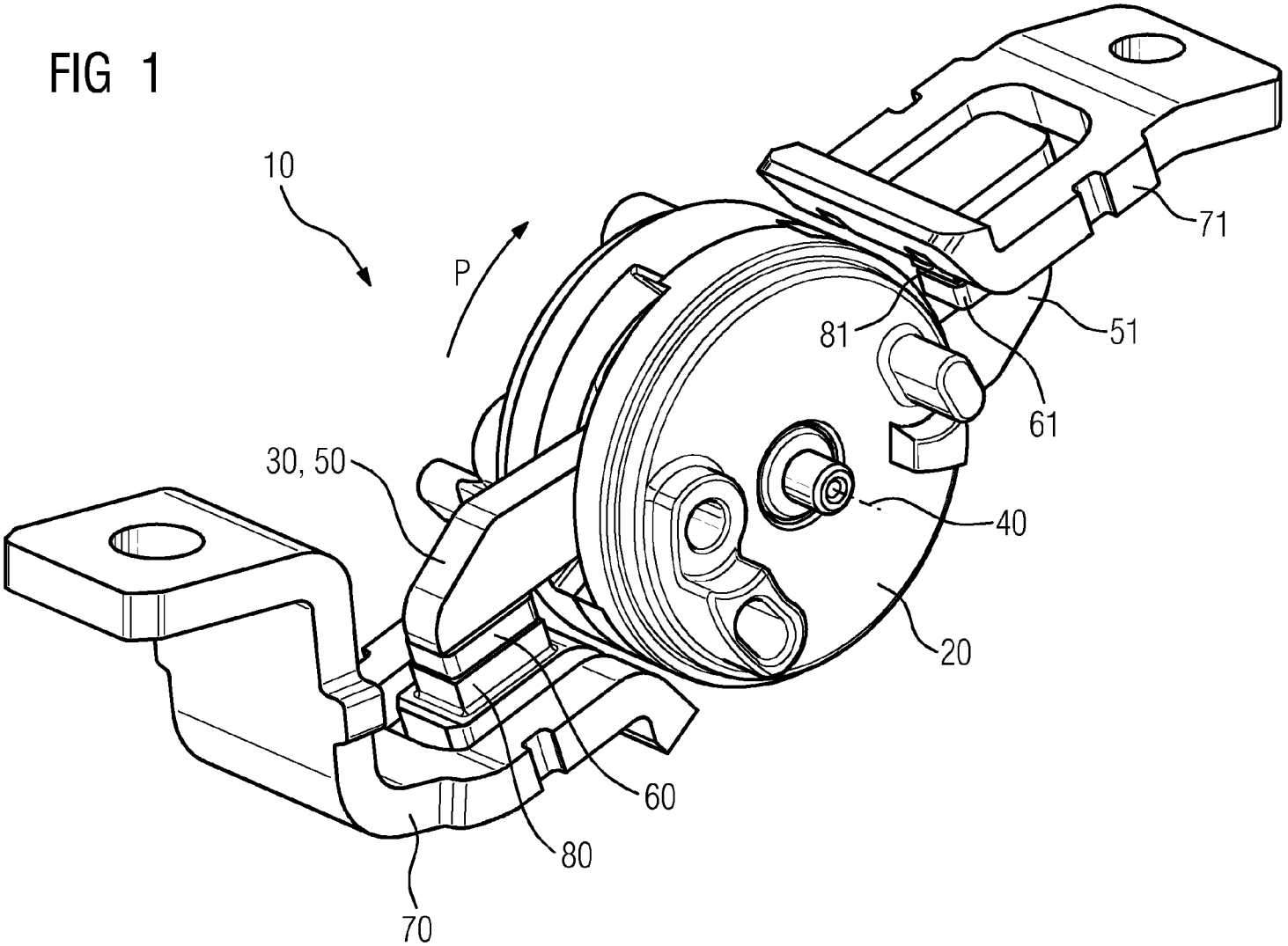
FIG. 1 shows an example embodiment of an electric contact system for an electric switch, with a contact bridge of the switch's contact system being shown in the switched-on state.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

A switch of at least one embodiment includes a display element that is coupled indirectly or directly to the rotor housing and, in one display position, indicates the rotor housing's ON position and, in another display position, indicates the rotor housing's OFF position.

An advantage of a switch of at least one embodiment is that the position of its rotor housing is in this case visualized by the provided displaceable display element. It is hence possible to identify the rotor housing's position and determine whether the switch is in a safe state, because only when the rotor housing assumes its OFF position will it be ensured that the switch must actually have been switched off and also that the contact arm mounted in the rotor housing must be assuming its OFF position. The switch hence also successfully addresses the problem of fused contacts. That is to say that if electric contacts of the switch have become fused together owing to, say, an overcurrent situation, then the rotor housing will be unable to assume its OFF position so that it will be possible to identify that state—independently of, for example, the position of a switch-engaging device.

The displaceable display element can indirectly or directly interact with the rotor housing. It is, though, seen as advantageous for there to be a deflecting element that interacts with a control element coupled to the rotor housing and which will displace the display element when the control element experiences a rotary motion.

The switch can have, for example, a contact bridge that includes the contact arm and another contact arm, with each of the two contact arms having a contact element fitted on its end.

So it can be mechanically displaced from outside, it is seen as advantageous for the switch to have an engaging device—in the form of, for instance, a control lever—that is coupled to the rotor housing and will in a trouble-free situation enable the switch to be switched on and off. The display element indicates the rotor housing's position preferably independently of the lever's position.

As regards displacing the display element, it is seen as advantageous for the deflecting element to convert a rotary motion of the control element into an upward motion of the displaceable display element.

So it can be automatically reset, it is seen as advantageous for the displaceable display element to be kept floating and, unless it is raised by the deflecting element or kept in a raised position by the deflecting element, to reach or drop (for example under the force of gravity or owing to a spring force) into its display position indicating the contact arm's OFF position.

It is advantageous for the deflecting element to rest externally upon the control element and for the control element's outer contour to be dependent on the rotation angle in such a way that the deflecting element will be moved, in particular pushed and/or swiveled, when the control element is turned.

The control element is preferably a control disk, for example a cam disk.

It is also seen as advantageous for the displaceable display element to reach or drop (for example under the force of gravity or owing to a spring force) into its display position indicating the rotor housing's OFF position when the rotor housing assumes its OFF position, and to be taken or raised (for example against the force of gravity or a spring force) into its display position indicating the rotor housing's ON position when the rotor housing assumes its ON position.

It is seen as advantageous as regards the embodiment of the deflecting element for it to include a moving lever, or to have been formed from such, which by way of its first lever arm is in mechanical contact with the control element and with the displaceable display element by way of its second lever arm.

With a view to providing a simple and economical switch structure, it is seen as advantageous for the first lever arm to rest (for example under the force of gravity or owing to a spring force) externally upon an outer contour of the control element and for the displaceable display element to rest upon the second lever arm (for example under the force of gravity or owing to a spring force).

It is proposed according to an embodiment that the displaceable display element be kept floating.

If the deflecting element is a lever that is held capable of swiveling (in the form preferably of a rocker), then it is seen as advantageous for the displaceable display element to reach or drop (for example under the force of gravity or owing to a spring force) into its display position indicating the rotor housing's OFF position when the lever's first lever arm is raised by the control element, and to be taken or raised into its display position indicating the rotor housing's ON position when the lever's first lever arm drops (for example under the force of gravity or owing to a spring force).

If the deflecting element is a lever that is held capable of being moved (for example translationally), then it is seen as advantageous for the displaceable display element to reach or drop (for example under the force of gravity or owing to a spring force) into its display position indicating the rotor housing's OFF position when the lever's first lever arm is lowered by the control element (for example under the force of gravity or owing to a spring force), and to be taken or raised (for example against the force of gravity or a spring force) into its display position indicating the rotor housing's ON position when the lever's first lever arm is raised.

The control element can have a guide link 133 that guides the deflecting element.

The control element can be a separate part linked to the rotor housing. It can be linked by way of, for example, a plug connection. The control element can have been, for example, plugged onto the rotor housing.

The control element can alternatively be joined to the rotor housing as a single piece therewith and/or form a constituent of the rotor housing.

FIG. 1 is a three-dimensional view of constituents of an electric contact system 10 for an electric switch. What can be seen is a rotor housing 20 that can be rotated in the direction of arrow P. Inside rotor housing 20 is a contact bridge 30 that can be swiveled jointly with rotor housing 20 or relatively to rotor housing 20 likewise in the direction of arrow P. The rotation axis around which contact bridge 30 as well as rotor housing 20 can be turned or, as the case may be, swiveled is identified by reference numeral 40 in FIG. 1.

Contact bridge 30 is formed by means of a first contact arm 50 as well as a second contact arm 51. Each of the two contact arms 50 and 51 has a contact element fitted on its end. The contact elements are identified by reference numerals 60 and 61 in FIG. 1.

What can further be seen in FIG. 1 are two stationary contact rails 70 and 71 that interact with contact bridge 30. Contact rails 70 and 71 are for that purpose each fitted with a stationary contact element 80 and 81 respectively.

Rotor housing 20 is in the ON position and contact bridge 30 is likewise in its ON position in the representation shown in FIG. 1: The switch is therefore closed so that an electric current can flow from contact rail 70 to contact rail 71 via contact bridge 30. To make that flow of current possible, contact elements 60 and 61 of contact bridge 30 are resting upon corresponding stationary contact elements 80 and 81 of the two contact rails 70 and 71.

Figure 2:
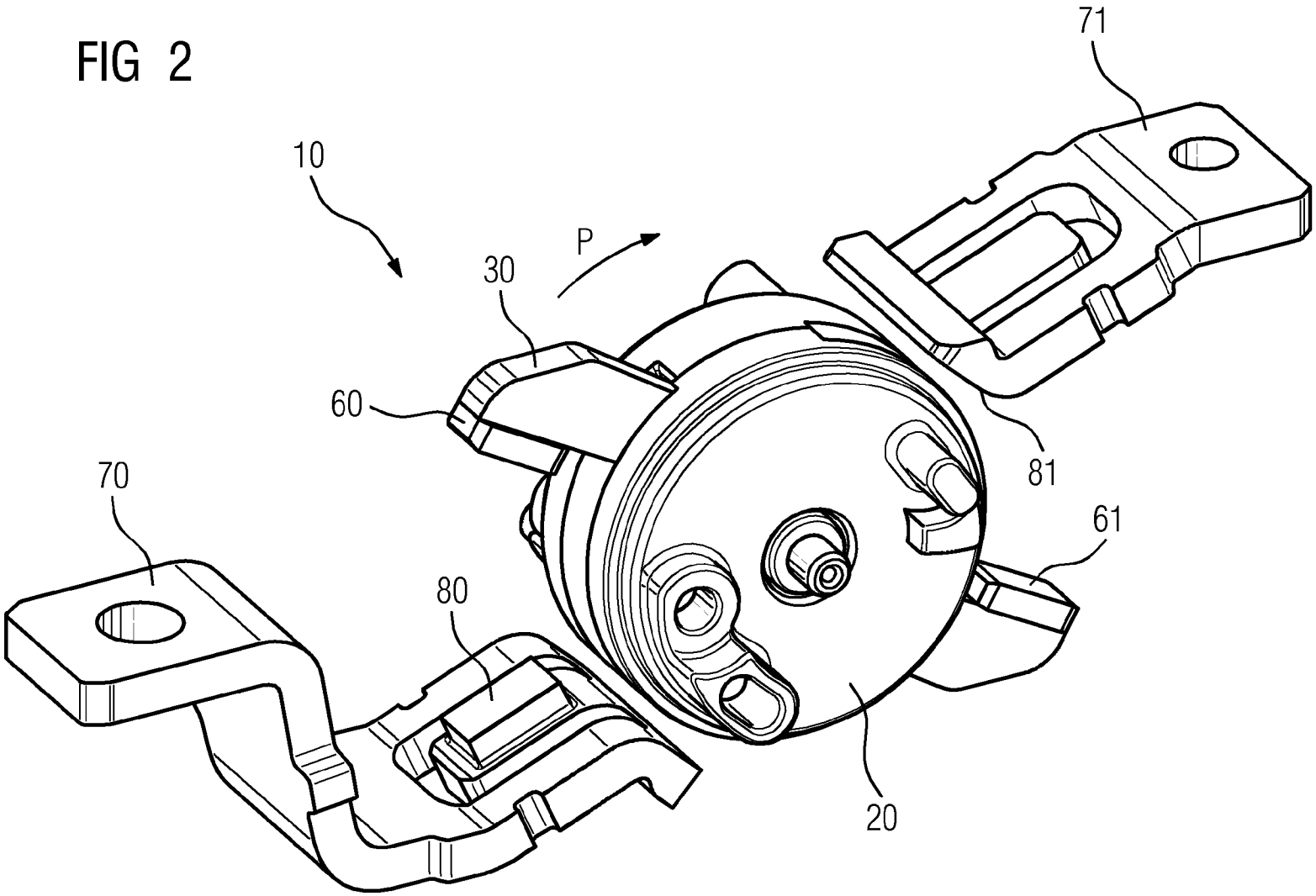
FIG. 2 shows the contact system shown in FIG. 1, with the contact bridge in a triggered position.

FIG. 2 shows contact system 10 shown in FIG. 1 in the triggered state: Contact bridge 30 is in its OFF position, with rotor housing 20 assuming its ON position unchanged. It can be seen that contact bridge 30 has been swiveled relative to rotor housing 20 as well as relative to the position shown in FIG. 1. Owing to the swivel angle, contact elements 60 and 61 of contact bridge 30 have been separated from corresponding stationary contact elements 80 and 81 of the two contact rails 70 and 71.

Figure 3:
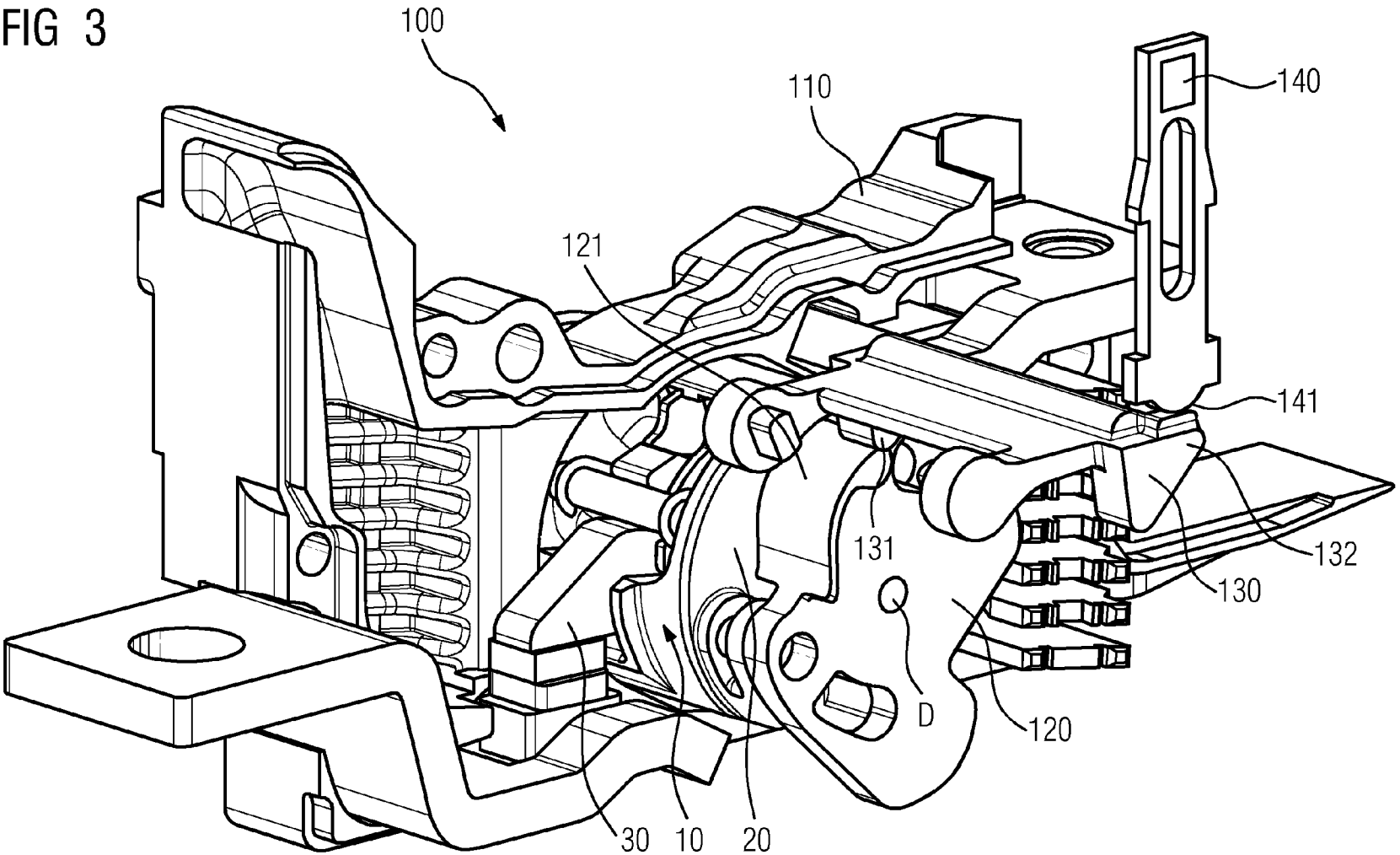
FIG. 3 shows an example embodiment of an inventive switch fitted with the contact system shown in FIGS. 1 and 2, with the contact bridge and a rotor housing of the switch being shown in their electric ON state.

FIG. 3 shows an example embodiment of a switch 100 fitted with contact system 10 shown in FIGS. 1 and 2. Contact system 10 is located inside a pole cassette 110 of switch 100.

It can be seen that a control element in the form of a control disk 120 has been plugged onto rotor housing 20 of contact system 10. Control disk 120 will hence co-turn with rotor housing 20 around the housing's rotation axis D. As can be seen in FIG. 3, outer contour 121 of control disk 120 is dependent on the rotation angle.

Switch 100 is furthermore fitted with a deflecting element in the form of a lever 130 whose first lever arm 131 interacts with outer contour 121 of control disk 120. Lever 130 has therein been mounted in such a way that first lever arm 131 will always rest upon outer contour 121 of control disk 120. The relative position of first lever arm 131 is therefore dependent on the respective rotation angle of rotor housing 20 because outer contour 121 of control disk 120 is—as already mentioned—dependent on the rotation angle. In other words, first lever arm 131 of lever 130 will be raised or lowered depending on the respective rotation angle of rotor housing 20.

Lever 130 can have been mounted as being displaceable and/or capable of being swiveled around a swivel axis so that resting upon outer contour 121 will be possible.

Lever 130 moreover has a second lever arm 132 upon which a lower end 141 of a display element 140 rests. So if second lever arm 132 of lever 130 is in what in FIG. 3 is a lower position, then display element 140 will also drop and assume a lower position. Display element 140 will analogously be raised by second lever arm 132 of lever 130 when it itself assumes its top position.

In the representation shown in FIG. 3, rotor housing 20 of switch 100 is in its ON position in which contact bridge 30 of contact system 10 is able to assume a closed position. It is therefore possible for contact bridge 30 to be current-carrying when rotor housing 20 is in the position shown in FIG. 3. That position of rotor housing 20 will then be indicated by the corresponding position of control disk 120, by the position of lever 130 and in particular by that of second lever arm 132, and hence by the position of display element 140; that is because display element 140 will be raised in the position in which rotor housing 20 is shown in FIG. 3, which will preferably be externally visible.

Figure 4:
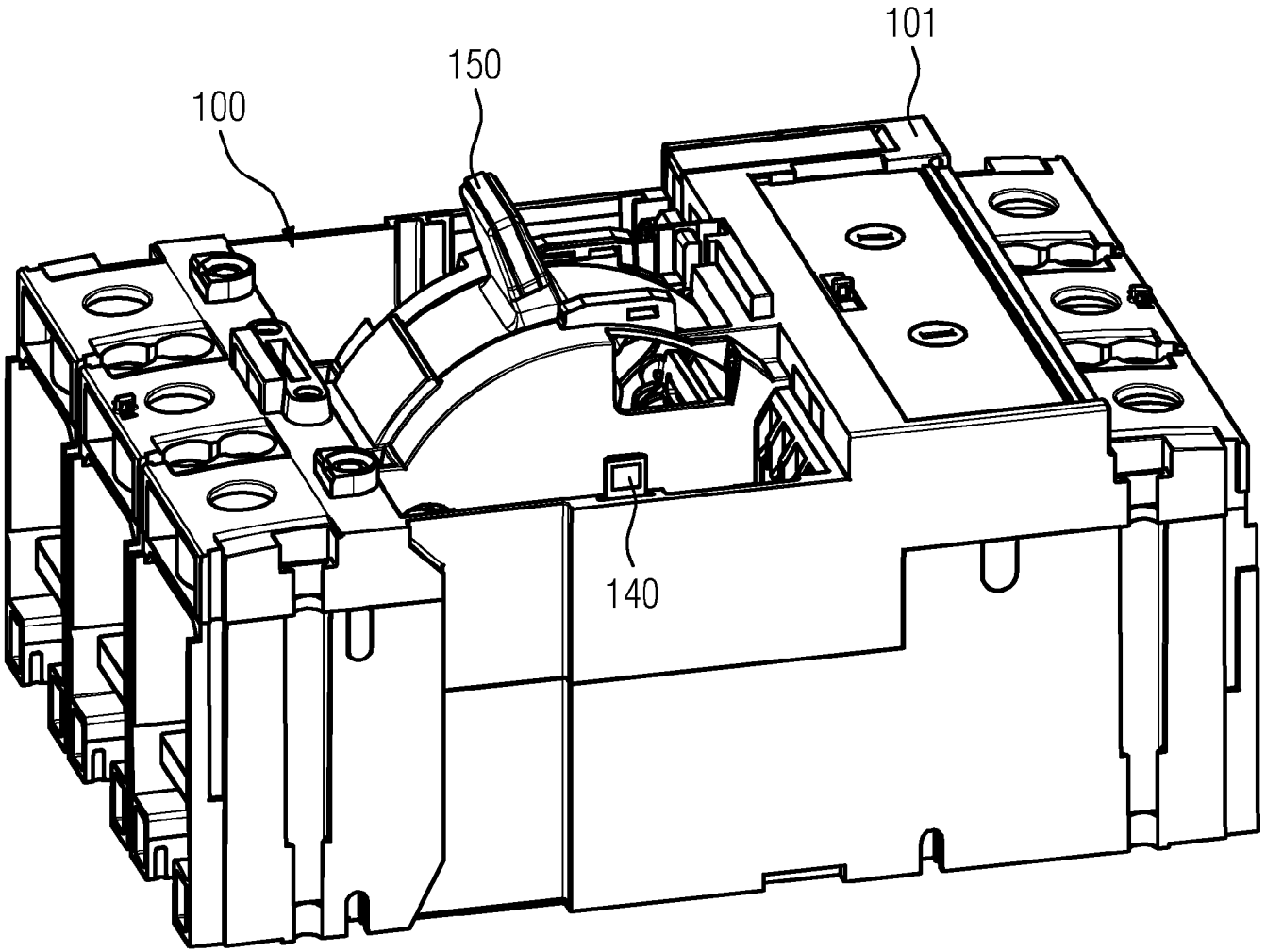
FIG. 4 is another representation of the electric switch shown in FIG. 3.

FIG. 4 is another representation of switch 100 when rotor housing 20 is in the ON position shown in FIG. 3. Second lever arm 132 of lever 130 will in that ON position—as already mentioned—raise display element 140 so that it can project from switch housing 101. The ON position of rotor housing 20 will therefore be discernible because of display element 140. Thus it will be externally visible to a user of switch 100 that the position of rotor housing 20 would make a closed state of contact bridge 30 possible. It is hence possible that the contact bridge 30 is in its ON position and that current can flow through switch 100. Display element 140 indicates that state independently of the respective actual position of contact bridge 30 and independently of the respective position of an engaging means 150 by means of which electric switch 100 can be activated or deactivated. Display element 140 thus enables a potentially switched-on state of switch 100 to be signaled even if engaging means 150 assumes a different position suggesting that switch 100 must have been switched off.

Figure 5:
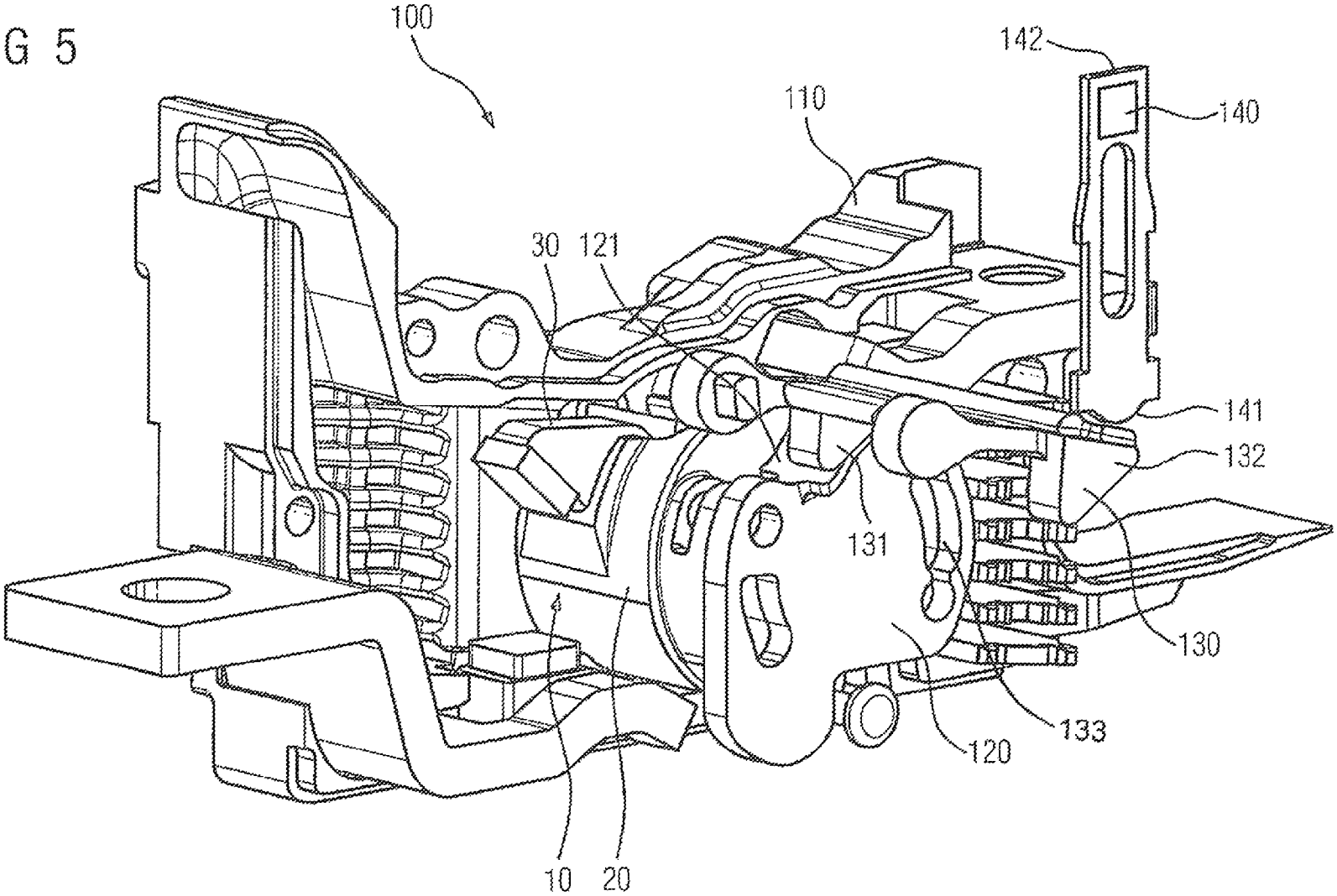
FIG. 5 shows the switch shown in FIGS. 3 and 4 in the switched-off state with the rotor housing in its OFF position.

FIG. 5 shows switch 100 shown in FIGS. 3 and 4 again but when rotor housing 20 is in the OFF position. As can be seen in FIG. 5, rotor housing 20 has been turned away from the ON position so that contact bridge 30 has perforce been swiveled likewise into its OFF position. A flow of current through contact system 10 will therefore be precluded when rotor housing 20 is in the OFF position shown in FIG. 5.

Control disk 120, whose outer contour 121 is dependent on the rotation angle, will in that OFF position also have been turned because rotor housing 20 has been turned. Owing to the rotation-angle dependency of outer contour 121, lever 130 will be deflected or, as the case may be, moved when rotor housing 20 is turned because first lever arm 131 rests upon outer contour 121. There will for that reason also be a change in the position of second lever arm 132 of lever 130.

In the example embodiment shown in FIG. 5, second lever arm 132 will be lowered when rotor housing 20 is turned into its OFF position so that display element 140 will also be lowered. Display element 140 will therefore assume a lower position in which, for example, it will no longer project from switch housing 101 of switch 100. So in contrast to what is shown in FIG. 4, top section 142 will, for example, no longer be visible when display element 140 is in a lower position. An operator will therefore be able to tell that electric switch 100 is in a safe state because rotor housing 20 has actually reached its OFF position.

While having been illustrated and described in detail based on the example embodiments, the invention is not limited by the examples disclosed and other variants can be deduced herefrom by a person skilled in the relevant art without departing from the scope of protection of the invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCES

10 Contact system
20 Rotor housing
30 Contact bridge
40 Rotation axis
50 Contact arm
51 Contact arm
60 Contact element
61 Contact element
70 Contact rail
71 Contact rail
80 Contact element
81 Contact element
100 Switch
101 Switch housing
110 Pole cassette
120 Control disk
121 Outer contour
130 Lever
131 First lever arm
132 Second lever arm
140 Display element
141 Lower end
142 Top section
150 Engaging means
D Rotation axis

What is claimed is:

1. An electric switch, comprising:

a rotor housing, configured to be turned to an ON and an OFF position;

at least one electric contact arm, rotatably mounted in the rotor housing, configured to be jointly swivelable with the rotor housing and relative to the rotor housing;

a display element, coupled indirectly or directly to the rotor housing, to, in one display position, indicate an ON position of the rotor housing and to, in another display position, indicate an OFF position of the rotor housing;

a control element mounted on the rotor housing and configured to be co-turnable when the rotor housing is turned; and a deflecting element in direct contact with an outer contour of the control element and in direct contact with the display element to displace the display element when the control element experiences a rotary motion.

2. The switch of claim 1, wherein the deflecting element is configured to convert a rotary motion of the control element into an upward motion of the displaceable display element.

3. The switch of claim 1, wherein the displaceable display element is configured to be kept in a first position and, unless raised by the deflecting element or kept in a raised position by the deflecting element, configured to reach the display position indicating the OFF position of the rotor housing.

4. The switch of claim 1, wherein the deflecting element is configured to rest externally upon the control element and wherein the outer contour of the control element is dependent on the rotation angle in such a way that the deflecting element is configured to be moved when the control element is turned.

5. The switch of claim 1, wherein the control element is a control disk.

6. The switch of claim 1, wherein the deflecting element includes a moving lever, or has been formed from a moving lever, which by way of a first lever arm of the moving lever is in mechanical contact with the control element and by way of a second lever arm of the moving lever is in mechanical contact with the displaceable display element.

7. The switch of claim 6, wherein the first lever arm rests externally upon the outer contour of the control element, and the displaceable display element rests upon the second lever arm.

8. The switch of claim 6, wherein the displaceable display element reaches the display position indicating the OFF position of the rotor housing when the rotor housing assumes its OFF position, and wherein the displaceable display element will be raised by the deflecting element and taken to the display position indicating the ON position of the rotor housing when the rotor housing assumes its ON position.

9. The switch of claim 1, wherein the control element includes a guide link and wherein the deflecting element is configured to be guided in the guide link.

10. The switch of claim 1, wherein the control element is a separate part that has been at least one of joined to and plugged onto the rotor housing.

11. The switch of claim 1, wherein the control element is joined to the rotor housing as a single piece therewith, and forms a constituent of the rotor housing.

12. The switch of claim 1, wherein the switch is an electric circuit-breaker.

13. The switch of claim 1, wherein the displaceable display element is configured to be kept in a first position and, unless raised by the deflecting element or kept in a raised position by the deflecting element, configured to reach the display position indicating the OFF position of the rotor housing.

14. The switch of claim 4, wherein the outer contour of the control element is dependent on the rotation angle in such a way that the deflecting element is configured to be at least one of pushed and swiveled when the control element is turned.

15. The switch of claim 1, wherein the deflecting element is configured to rest externally upon the control element and wherein the outer contour of the control element is dependent on the rotation angle in such a way that the deflecting element is configured to be moved when the control element is turned.

16. The switch of claim 15, wherein the outer contour of the control element is dependent on the rotation angle in such a way that the deflecting element is configured to be at least one of pushed and swiveled when the control element is turned.

17. The switch of claim 5, wherein the control element is a cam disk.

18. The switch of claim 7, wherein the displaceable display element reaches the display position indicating the OFF position of the rotor housing when the rotor housing assumes its OFF position, and wherein the displaceable display element will be raised by the deflecting element and taken to the display position indicating the ON position of the rotor housing when the rotor housing assumes its ON position.

19. The switch of claim 1, wherein the display element projects from an outer surface of the switch when the displaceable display element is raised by the deflecting element and taken to the display position when the rotor housing assumes the ON position.

* * * * *